US007726484B2

(12) United States Patent
Komatsu et al.

(10) Patent No.: US 7,726,484 B2
(45) Date of Patent: Jun. 1, 2010

(54) PACKAGING MATERIAL OF GAS-BAG TYPE, PROCESS FOR PACKAGING ARTICLE, AND PROCESS FOR PRODUCING PACKAGING MATERIAL

(75) Inventors: Norimitsu Komatsu, Numazu (JP); Hirobumi Sugano, Susono (JP)

(73) Assignee: Ricoh Company, Ltd., Tokyo (JP)

( * ) Notice: Subject to any disclaimer, the term of this patent is extended or adjusted under 35 U.S.C. 154(b) by 159 days.

(21) Appl. No.: 11/482,816

(22) Filed: Jul. 10, 2006

(65) Prior Publication Data

US 2007/0017844 A1 Jan. 25, 2007

Related U.S. Application Data

(63) Continuation of application No. PCT/JP2005/000324, filed on Jan. 6, 2005.

(30) Foreign Application Priority Data

Jan. 8, 2004 (JP) ..... 2004-002794

(51) Int. Cl.
*B65D 81/00* (2006.01)

(52) U.S. Cl. ..... 206/522

(58) Field of Classification Search ..... 206/522; 383/3

See application file for complete search history.

(56) References Cited

U.S. PATENT DOCUMENTS 4,085,785 A * 4/1978 Hoot ..... 220/592.24
4,826,329 A * 5/1989 Bellini ..... 383/3
4,874,093 A * 10/1989 Pharo ..... 206/522
5,340,632 A * 8/1994 Chappuis ..... 428/71
5,350,000 A * 9/1994 Wang ..... 150/166
5,469,966 A * 11/1995 Boyer ..... 206/522
5,727,270 A * 3/1998 Cope et al. ..... 5/710
5,826,723 A * 10/1998 Jaszai ..... 206/522
5,862,914 A * 1/1999 Farison et al. ..... 206/522
5,890,525 A * 4/1999 Shores ..... 150/166
6,076,677 A * 6/2000 Pozzo ..... 206/522
6,244,440 B1 * 6/2001 Tschantz et al. ..... 206/522
6,398,029 B1 * 6/2002 Farison et al. ..... 206/522

(Continued)

FOREIGN PATENT DOCUMENTS

JP 5-16671 3/1993

(Continued)

*Primary Examiner*—Jacob K Ackun, Jr.
(74) *Attorney, Agent, or Firm*—Oblon, Spivak, McClelland, Maier & Neustadt, L.L.P.

(57) ABSTRACT

The objects of the present invention are to provide a packaging material of gas-bag type for packaging easily deformable parts or devices of office equipment or OA equipment having various sizes and shapes such as containers containing toner, containers containing developing agent, photoconductors, process cartridges, and complex units of a developer and a toner collector.

In order to achieve the object, a packaging material of gas-bag type is provided which comprises tube-like bodies and connecting portions, wherein the tube-like bodies are able to swell by being injected inner gas, the connecting portions connect the tube-like bodies in parallel, the tube-like bodies are bendable so as to wrap an article to be packaged, and the packaging material is formed from substantially flat two sheets of one front sheet and one back sheet in a condition that the inner gas is substantially evacuated from the tube-like bodies.

24 Claims, 8 Drawing Sheets

U.S. PATENT DOCUMENTS

| | | | | |
|---|---|---|---|---|
| 2005/0109656 | A1* | 5/2005 | Ishizaki | 206/522 |
| 2005/0247592 | A1* | 11/2005 | Peper et al. | 206/522 |
| 2005/0263425 | A1* | 12/2005 | Tanaka et al. | 206/522 |
| 2006/0032779 | A1* | 2/2006 | Tanaka et al. | 206/522 |

FOREIGN PATENT DOCUMENTS

| | | | |
|---|---|---|---|
| JP | 6-51178 | | 7/1994 |
| JP | 6-40127 | | 10/1994 |
| JP | 8-11939 | | 1/1996 |
| JP | 3039149 | | 4/1997 |
| JP | 2000-62850 | | 2/2000 |
| JP | 2002-145264 | | 5/2002 |
| WO | WO 02/083521 | A1 | 10/2002 |
| WO | WO 03/072456 | A1 | 9/2003 |

* cited by examiner

PACKAGING MATERIAL OF GAS-BAG TYPE, PROCESS FOR PACKAGING ARTICLE, AND PROCESS FOR PRODUCING PACKAGING MATERIAL

CROSS-REFERENCE TO RELATED APPLICATIONS

This is a continuation of Application No. PCT/JP2005/000324, filed on Jan. 6, 2005.

BACKGROUND OF THE INVENTION

1. Field of the Invention

The present invention relates to packaging materials of a gas-bag type which are adapted to provide packaging of parts or devices of office equipment or office automation (OA) equipment, in particular, complicated, precise, and delicate parts or devices, and also slippery and/or elongated parts or devices; processes for packaging articles by means of the packaging materials, and processes for producing the packaging materials.

2. Description of the Related Art

Recently, office equipment, OA equipment, and office machines have been demanded to reduce size and weight, to increase functionality, to lower cost, and to enhance performance. In such background of the art, parts or devices such as toner cartridges, photoconductor units, developing units, complex assemblies of a photoconductor and a developer, and complex units of a developer and a toner collector utilized for the office equipment, OA equipment, and office machines such as copiers, facsimiles, and printers have reduced their size and weight. These reductions of size and weight have reduced durability against deformation and destruction; on the other hand, such parts or devices have increased their functionalities and performances.

Accordingly, minor deformation or destruction tends to result in a serious or critical damage of the parts or devices; thus the packaging of such parts or devices and their transportation and storage have come to be significantly important.

Conventionally, office equipment or electrical equipment is typically disposed at a concave portion of cushioning packaging material such as styrenefoam, or only both ends are supported by cushioning packaging material such as styrenefoam, then are constrained in a cardboard box, and collected, transported, and stored, as shown in FIG. 6. However, the styrenefoam is bulky since bubbles occupy about 98% by volume of the material; therefore there has been a problem that the material should be addressed by some way. Further, since a kind of parts or devices such as containers of developing agent are bottles or cartridges made of resins, such containers hardly deform and thus may be easily set to a main body of the equipment.

On the contrary, from the view point of environmental issues, easily deformable bags are commercially utilized nowadays in order to reduce the amount of packaging material as well as to reduce the volume and amount of waste products. In some cases, containers are filled with powder and may be utilized directly as cartridges.

When such easily deformable containers are employed as parts or devices of office equipment or OA equipment in a form of a cartridge, there often arise a problem that the cartridge cannot be smoothly set to the main body of the equipment due to deformation or breakage during transportation or due to solidification of content along with deformation of the parts or devices. Further, not breakage but mere folding of containers at narrow site such as neck of the container may lead to the setting impossible or missing sometimes.

In order to address such problems, cushioning material has been utilized as packaging material. However, it has been experienced that the amount of packaging material is increased, the cost for package is raised, and the efficiency of transportation and storage are decreased due to enlarged package, when the parts or devices are contained in boxes made of the cushioning material. In addition, the boxes containing parts or devices of office equipment or OA equipment should usually be stored in a certain direction in order to prevent the breakage or deformation of the parts or devices.

As such, novel packaging materials and/or packaging processes are demanded in the art that afford to collect, transport, and store parts or devices of office equipment or OA equipment without occurrences of breakage and deformation, and allow to take out easily from the package while providing sufficient cushioning effect; and also the volume reduction, collection, and reuse are easily carried out economically after the usage.

Japanese Utility Model Registration (JP-Y) No. 3039149 proposes a partitioned corrugated box for package and protection of two articles, in which a corrugated box is partitioned; thereby deformation of contained articles is reduced. However, in the partitioned corrugated box capable of containing two articles, if the articles are sold separately, either of the two articles should be sold; the deformation of the container shape and the solidification of the content may lead to failure of setting to the main body of the equipment, when the article is not utilized immediately. Further, the increased amount of the cushioning material brings about raise of packaging cost and increase of waste packaging material; and enlarged package boxes themselves result in decrease of transporting efficiency. In addition, the partitioned corrugated boxes typically present a rectangular shape, namely, narrowing the design range.

Japanese Patent Application Laid-Open (JP-A) No. 2002-145264 discloses a package structure for litho printing board 114 as shown in FIG. 7, in which intermediate package body 110 is stacked on pallet portion 128 of box pallet 126 and stored in box portion 129, plural air bags 148 are inserted into the space between box portion 129 of box pallet 126 and intermediate package body packed by package members 142, 144; pressured air is filled into the air bags depending on the space volume between box portion 129 and intermediate package body 110. Air bags 148 filled with pressured air can constrain intermediate package body 110 stored in box portion 129, and can protect bundle 113 by cushioning outer shock.

As a result, various litho printing boards having different sizes are allegedly packed in a simple fashion without altering the size of packaging material for the various litho printing boards, and also the packaging material after usage can be effectively recycled. However, when corrugated boxes are utilized for package boxes in the process, moisture may effect adversely on the content, thus the protection of the content is not perfectly reliable.

Japanese Utility Model Application Laid-Open (JP-U) No. 6-51178 discloses a packaging device for packaging precision electronic parts or devices as shown in FIG. 8, in which the device includes first cushioning member 81 and second cushioning member 82 of bag-like vinyl sheet that are formed by arranging plural concave disposing portions 84, 85 for sustaining electronic parts or devices; connecting portion 83 formed by folding and duplicating the cushioning members 81, 82 and connected freely; an air inlet provided at the first cushioning material 81; and connecting path 83 to connect the inside of cushioning members 81, 82; wherein the parts or devices are gripped and sustained between disposing portion 84 of the first cushioning member 81 filled with air and the opposite disposing portion 85 of the second cushioning member 82.

In the packaging device, the packaging of precision electronic parts or devices may be carried out easily, and the cushioning member may be properly handled, and also the space for storing may be reduced. However, in the packaging device, the first cushioning member 81 and second cushioning member 82 of bag-like vinyl sheet cannot cover the precision electronic parts or devices sufficiently or perfectly.

Japanese Patent Application Laid-Open (JP-A) No. 2000-62850 discloses a packaging device for packaging articles such as copiers as shown in FIG. 9, in which two cushioning members 913 filled with air are wrapped around article 902 such as a copier to be packaged, supporting pillars 907 are inserted at the end of each cushioning material 913, adjacent supporting pillars 907 are connected by connecting member 903, and a valve is provided to cushioning material 913 into which air is injected, which is intended to package articles such as copiers easily, and to remove the package easily, to protect the articles certainly, and to decompose and transport easily after usages.

However, the packaging device is intended to package articles having relatively large size such as copiers, thus is not suitable to apply to parts or devices of office equipment or OA equipment.

SUMMARY OF THE INVENTION

The objects of the present invention are to provide a packaging material of gas-bag type, a process for packaging an article, and a process for producing the packaging material of gas-bag type, for packaging easily deformable parts or devices of office equipment or OA equipment having various sizes and shapes such as containers containing toner, containers containing developing agent, photoconductors, process cartridges, and complex units of a developer and a toner collector; wherein deformation of the containers during transportation and breakage or deformation of the parts or devices due to solidification of content may be suppressed, setting of the parts or devices may be carried out easily, the parts or devices may be packaged without cushioning material, the parts or devices may be properly protected and fixed, superior design may be performed, the packaged parts or devices may be suitably housed into packaging boxes, and volume reduction and recycle may be easily carried out, and also repeated usages are possible.

The packaging material of gas-bag type according to the present invention includes tube-like bodies and connecting portions, wherein the tube-like bodies are able to swell by being injected with inner gas, the connecting portions connect the tube-like bodies in parallel, the tube-like bodies are bendable so as to wrap an article to be packaged, and the packaging material is formed from two substantially flat sheets of one front sheet and one back sheet such that the inner gas is substantially evacuated from the tube-like bodies.

The packaging material of gas-bag type according to the present invention is flexible and resilient and also may be less slippery in the condition that inner gas is injected into the tube-like bodies; therefore, parts or devices of office equipment or OA equipment having various sizes and shapes such as containers containing toner, containers containing developing agent, photoconductors, process cartridges, and complex units of a developer and a toner collector may be firmly fixed or sustained in the packaging material. Further, the volume of packaged articles is relatively small; separation or drop of articles from the packaging material may be effectively prevented; the packaged articles may display higher impact resistance; transportation is relatively easy; decomposition of the packaged articles is relatively easy; the packaging material may be repeatedly utilized in decomposition and packaging; volume reduction may be conducted in two steps; and the cost of the packaging material is lower even having sufficient adaptability of recycle and reuse.

Preferably, the packaging material is bendable to at least one of front side and back side of the packaging material in substantially perpendicular directions to the axis of the tube-like bodies.

Preferably, the packaging material includes adhered areas, non-adhered areas, and a gas entrance, the non-adhered areas represent non-adhesion between the front sheet and the back sheet and provide passages which communicate gas between the tube-like bodies, and the adhered areas provide adhesion between the front sheet and the back sheet and provide connecting portions and sealing portions at the margin of the packaging material.

Preferably, each of the gas passages is provided at a part of each connecting portion, and at least a part of connecting portions possesses at least one connectable portion.

Preferably, each tube-like body possesses nodes at which portion the tube-like body swells larger compared to the other portion of the tube-like body.

Preferably, one of the front sheet and the back sheet is a transparent resin sheet, and the other sheet possesses a concave-convex surface.

Preferably, the sheet possessing a concave-convex surface represents a laminated construction of a resin film sheet and a divided-assigned sheet.

Preferably, the resin film sheet is formed from three layers of polyethylene film, polyamide film, and polyethylene film.

Preferably, both of the transparent resin sheet and the sheet possessing a concave-convex surface have an oxygen-gas permeability of 3 $cc/m^2/24$ hours or less.

Preferably, at least a part of connecting portions possesses at least one tearable perforated line in parallel to the axis of the tube-like bodies, each axis of the tube-like bodies is bendable to at least one of the front side and back side of the packaging material, and at least one end portion of the tube-like bodies possesses a connectable portion.

Preferably, at least a part of connecting portions possesses at least one cut line in parallel to the axis of the tube-like bodies, each axis of the tube-like bodies is bendable to at least one of the front side and back side of the packaging material, and at least one end portion of the tube-like bodies possesses a connectable portion.

Preferably, the tube-like bodies are attachable and detachable from each other repeatedly at the connectable portion.

Preferably, at least a part of tube-like bodies possess at least one additional adhered area at the end portion of the tube-like bodies.

Preferably, the at least one additional adhered area at the end portion of the tube-like bodies possesses at least one tearable perforated line.

Preferably, the gas entrance is provided to one of the tube-like bodies at the end portion.

Preferably, an elongated gripping portion is provided to the packaging material substantially in parallel to the axis of the tube-like bodies.

Preferably, the friction between the sheet possessing a concave-convex surface and the packaged article is larger than the friction between the transparent resin sheet and the packaged article.

Preferably, the pressure of the inner gas injected into the tube-like bodies is 6 hPa to 9 hPa, and the inner gas is nitrogen gas.

Preferably, the width of the connecting portions that connect the tube-like bodies in parallel is 0.5 cm to 3 cm.

Preferably, the diameter of the tube-like bodies is 2 cm to 10 cm.

Preferably, the number of the tube-like bodies is 2 or more.

Preferably, the article to be packaged is at least one of parts and devices utilized in office equipment and OA equipment.

Preferably, the article to be packaged is selected from the group consisting of containers containing toner, containers containing developing agent, photoconductors, process cartridges, and complex units of a developer and a toner collector.

The process for packaging an article according to the present invention, by means of a packaging material of gas-bag type including tube-like bodies and connecting portions, includes:

disposing an article to be packaged on the packaging material, bending the tube-like bodies toward the article to be packaged, and connecting at least one of the connecting portions and tube-like bodies, wherein the tube-like bodies are able to swell by being injected with inner gas, the connecting portions connect the tube-like bodies in parallel, the tube-like bodies are bendable so as to wrap an article to be packaged, and the packaging material is formed from two substantially flat sheets of one front sheet and one back sheet such that the inner gas is substantially evacuated from the tube-like bodies.

Preferably, the packaging material is bendable to at least one of front side and back side of the packaging material in substantially perpendicular directions to the axis of the tube-like bodies.

Preferably, the packaging material includes adhered areas, non-adhered areas, and a gas entrance, the non-adhered areas represent non-adhesion between the front sheet and the back sheet and provide passages which communicate gas between the tube-like bodies, and the adhered areas provide adhesion between the front sheet and the back sheet and provide connecting portions and sealing portions at the margin of the packaging material.

Preferably, each of the gas passages is provided at a part of each connecting portion, and at least a part of connecting portions possesses at least one connectable portion.

Preferably, each tube-like body possesses nodes at which portion the tube-like body swells larger compared to the other portion of the tube-like body.

Preferably, one of the front sheet and the back sheet is a transparent resin sheet, and the other sheet possesses a concave-convex surface.

Preferably, the sheet possessing a concave-convex surface represents a laminated construction of a resin film sheet and a divided-assigned sheet.

Preferably, the resin film sheet is formed from three layers of polyethylene film, polyamide film, and polyethylene film.

Preferably, both of the transparent resin sheet and the sheet possessing a concave-convex surface have an oxygen-gas permeability of 3 cc/$m^2$/24 hours or less.

Preferably, at least a part of connecting portions possesses at least one tearable perforated line in parallel to the axis of the tube-like bodies, each axis of the tube-like bodies is bendable to at least one of the front side and back side of the packaging material, and at least one end portion of the tube-like bodies possesses a connectable portion.

Preferably, at least a part of connecting portions possesses at least one cut line parallel to the axis of the tube-like bodies, each axis of the tube-like bodies is bendable to at least one of the front side and back side of the packaging material, and at least one end portion of the tube-like bodies possesses a connectable portion.

Preferably, the tube-like bodies are attachable and detachable from each other repeatedly at the connectable portion.

Preferably, at least a part of tube-like bodies possesses at least one additional adhered area at the end portion of the tube-like bodies.

Preferably, the at least one additional adhered area at the end portion of the tube-like bodies possesses at least one tearable perforated line.

Preferably, the gas entrance is provided to one of the tube-like bodies at the end portion.

Preferably, an elongated gripping portion is provided to the packaging material substantially in parallel to the axis of the tube-like bodies.

Preferably, the friction between the sheet possessing a concave-convex surface and the packaged article is larger than the friction between the transparent resin sheet and the packaged article.

Preferably, the pressure of the inner gas injected into the tube-like bodies is 6 hPa to 9 hPa, and the inner gas is nitrogen gas.

Preferably, the width of the connecting portions that connect the tube-like bodies in parallel is 0.5 cm to 3 cm.

Preferably, the diameter of the tube-like bodies is 2 cm to 10 cm.

Preferably, the number of the tube-like bodies is 2 or more.

Preferably, the article to be packaged is at least one of parts and devices utilized in office equipment and OA equipment.

Preferably, the article to be packaged is selected from the group consisting of containers containing toner, containers containing developing agent, photoconductors, process cartridges, and complex units of a developer and a toner collector.

The process for producing a packaging material of gas-bag type according to the present invention that possesses tube-like bodies and connecting portions includes:

laminating partially a front sheet and a back sheet to form adhered areas which correspond to the connecting portions and sealing portions at margin of the packaging material, and non-adhered areas which corresponds to the tube-like bodies and gas passages communicating the tube-like bodies, and swelling the non-adhered areas to form the tube-like bodies and the gas passages communicating the tube-like bodies by injecting inner gas from a gas entrance, wherein the tube-like bodies are able to swell by being injected inner gas, the connecting portions connect the tube-like bodies in parallel, the tube-like bodies are bendable so as to wrap an article to be packaged, and the packaging material is formed from substantially flat two sheets of one front sheet and one back sheet in a condition that the inner gas is substantially evacuated from the tube-like bodies.

Preferably, the packaging material is bendable to at least one of front side and back side of the packaging material in substantially perpendicular directions to the axis of the tube-like bodies.

Preferably, the pressure of the inner gas injected into the tube-like bodies is 6 hPa to 9 hPa, and the inner gas is nitrogen gas.

Preferably, the width of the connecting portions that connect the tube-like bodies in parallel is 0.5 cm to 3 cm.

Preferably, the diameter of the tube-like bodies is 2 cm to 10 cm.

Preferably, the number of the tube-like bodies is 2 or more.

Preferably, the article to be packaged is at least one of parts and devices utilized in office equipment and OA equipment.

Preferably, the article to be packaged is selected from the group consisting of containers containing toner, containers containing developing agent, photoconductors, process cartridges, and complex units of a developer and a toner collector.

DESCRIPTION OF THE PREFERRED EMBODIMENTS

Figure 1:
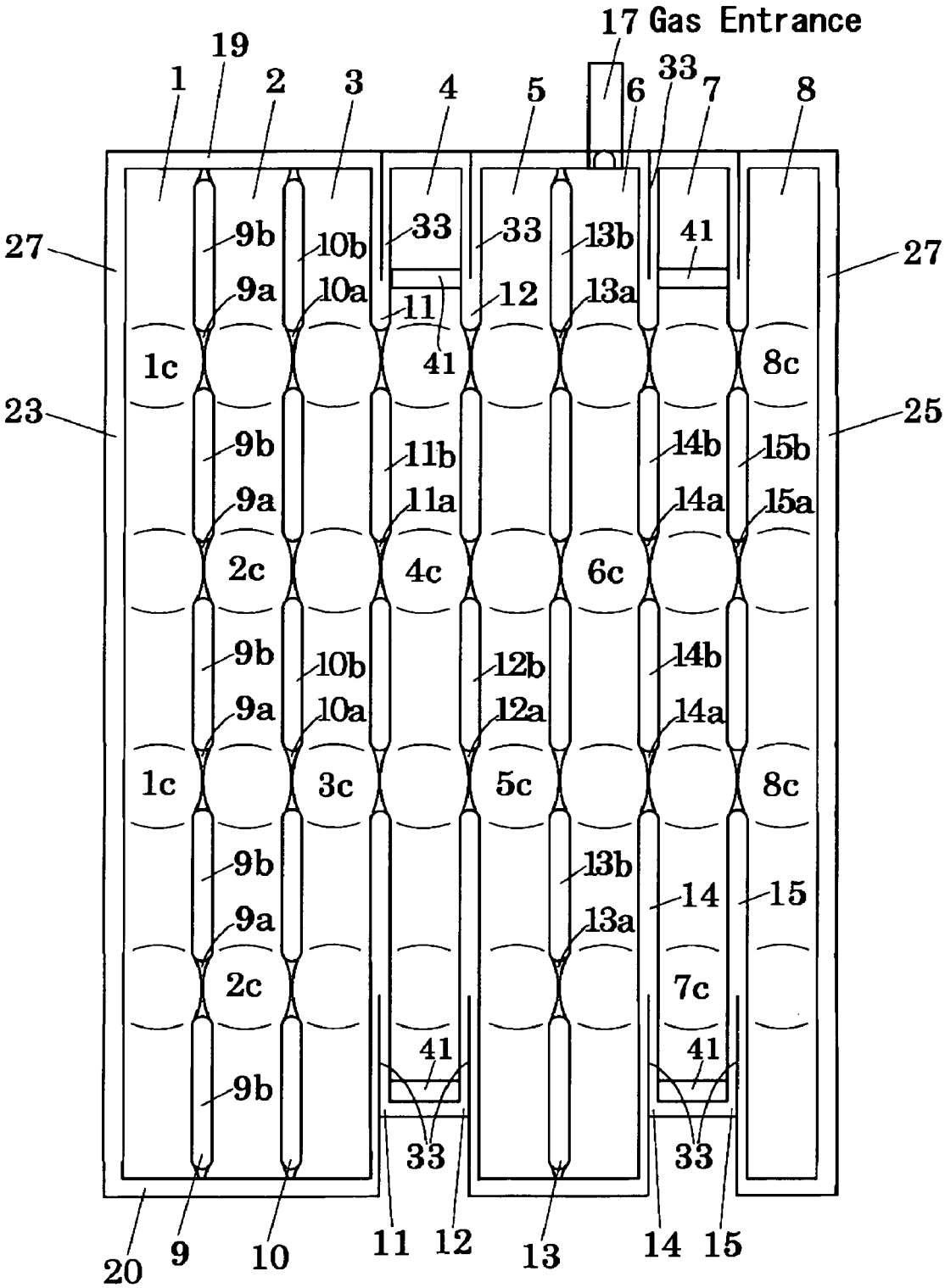
FIG. 1 is a schematic plan view of an exemplary packaging material of gas-bag type according to the present invention.

Packaging Material of Gas-Bag Type, Process for Packaging Article, and Process for Producing Packaging Material The packaging material according to the present invention includes tube-like bodies, connecting portions, and other members depending on requirements.

The process for packaging an article according to the present invention utilizes the packaging material according to the present invention. The process for producing a packaging material according to the present invention produces the packaging material according to the present invention. The process for packaging an article and the process for producing a packaging material will be clarified through explanations with respect to the packaging material of gas-bag type according to the present invention.

The packaging material of gas-bag type according to the present invention includes tube-like bodies and connecting portions, wherein the tube-like bodies are inflated by injecting gas, the connecting portions connect the tube-like bodies in parallel, and the tube-like bodies are bendable so as to wrap an article to be packaged.

The packaging material is preferably bendable to both of front and back sides of the packaging material in perpendicular directions to the axis of the tube-like bodies.

The number of the tube-like bodies connected in parallel may be selected depending on the required application; preferably, the number is 2 or more.

The packaging material preferably represents a sheet-like configuration formed of one front sheet and one back sheet in a condition where gas within the tube-like bodies is substantially evacuated.

The front sheet and the back sheet preferably provide non-adhered areas and adhered areas, the non-adhered areas represent non-adhesion between the front sheet and the back sheet and provide passages which communicate gas between the tube-like bodies, and the adhered areas provide adhesion between the front sheet and the back sheet and provide the connecting portions and sealing portions at the margin of the packaging material.

Each of the gas passages is preferably provided at a part of each connecting portion, and at least a part of connecting portions possesses at least one connectable portion; the tube-like bodies may preferably attach and detach from each other repeatedly at the connectable portion; and each tube-like body preferably possesses nodes at which the tube-like body inflates larger compared to other portions of the tube-like body.

Preferably, one of the front sheet and the back sheet is a transparent resin sheet, and the other sheet possesses a concave-convex surface. The transparent resin sheet may be formed of polyethylene, polypropylene, polyester, polycarbonate and the like; the sheet may be mono-layer sheet or laminated layer sheet thereof; the lamination may be performed by fusing, adhesion, and the like.

Preferably, the sheet possessing a concave-convex surface represents a laminated construction of a resin film sheet and a divided-assigned sheet, and the resin film sheet is formed from three layers of polyethylene, polyamide, and polyethylene. Examples of the material of the divided-assigned sheet include polyethylene, polypropylene, polyester, polycarbonate, and the like; the material may be selected independently with the materials of the resin film sheet and the divided-assigned sheet.

Preferably, both the transparent resin sheet and the sheet possessing a concave-convex surface have an oxygen-gas permeability of 3 $cc/m^2/24$ hours or less. The oxygen-gas permeability may be determined by means of a method for determining gas permeability defined in JIS K7126, for example.

Preferably, at least a part of connecting portions possess at least one tearable perforated line in parallel to the axis of the tube-like bodies, each axis of the tube-like bodies is bendable to both of the front and back sides of the packaging material, and at least one end portion of the tube-like bodies possesses a connectable portion.

Preferably, at least a part of connecting portions possess at least one cut line in parallel to the axis of tube-like bodies, each axis of the tube-like bodies is bendable to both of the front and back sides of the packaging material, and at least one end portion of the tube-like bodies possesses a connectable portion.

Preferably, the tube-like bodies are attachable and detachable from each other repeatedly at the connectable portion; at least a part of tube-like bodies possesses at least one additional adhered area at the end portion of the tube-like bodies; and at least one additional adhered area at the end portion of the tube-like bodies possesses at least one tearable perforated line.

Preferably, the gas entrance is provided to one of the tube-like bodies at the end portion; an elongated gripping portion is provided to the packaging material substantially in parallel to the axis of the tube-like bodies; and the friction between the sheet possessing a concave-convex surface and the packaged article is larger than the friction between the transparent resin sheet and the packaged article. The friction coefficient may be determined by means of a method for determining friction coefficient defined in JIS K7125, for example.

Preferably, the pressure of the inner gas injected into the tube-like bodies is 6 hPa to 9 hPa. Examples of the inner gas include air and nitrogen gas; preferably, the inner gas is nitrogen gas.

Preferably, the article to be packaged is a part or device utilized in office equipment and OA equipment; and the article to be packaged is selected from the group including containers containing toner, containers containing developing agent, photoconductors, process cartridges, and complex units of a developer and a toner collector.

FIG. 1 shows a packaging material of gas-bag type according to the present invention, in which the packaging material is at the stage that gas begins to enter into it starting from approximately sheet-like condition without inner gas. In the packaging material of gas-bag type, eight pieces of flexible tube-like bodies 1 to 8 are disposed in parallel and connected by connecting portions 9 to 15. Obviously, the number of passages 9*a* to 15*a* may be over or under eight. Connecting portions 9 to 15 are so flexible that they are bendable to the back side and front side; thus tube-like bodies 1 to 8 are bendable to the back side and front side at connecting portions 9 to 15.

Preferably, the exemplary packaging material of gas-bag type is prepared by forming adhered areas and non-adhered areas of two flexible sheet materials in a partially laminated fashion. The non-adhered areas correspond to swellable areas by injecting gas, thereby forming flexible tube-like bodies 1 to 8. In connecting portions 9 to 15, gas passages 9*a* to 15*a* are formed, which correspond to the non-adhered areas. Passages 9*a* to 15*a* serve to direct gas injected from gas entrance 17 provided at a tube-like body (6 in FIG. 1) into the other tube-like bodies 1 to 5 and 7, 8, and to exhaust the gas out of gas entrance 17 through tube-like bodies 1 to 5, 7 and 8.

The adhered areas correspond to connected portions 9*b* to 15*b* of connecting portions 9 to 15, sealing portions 19 and 20 at both ends in the axial direction of tube-like bodies 1 to 8, and sealing portions 23 and 25 at both right and left sides of the packaging material.

Figure 3:
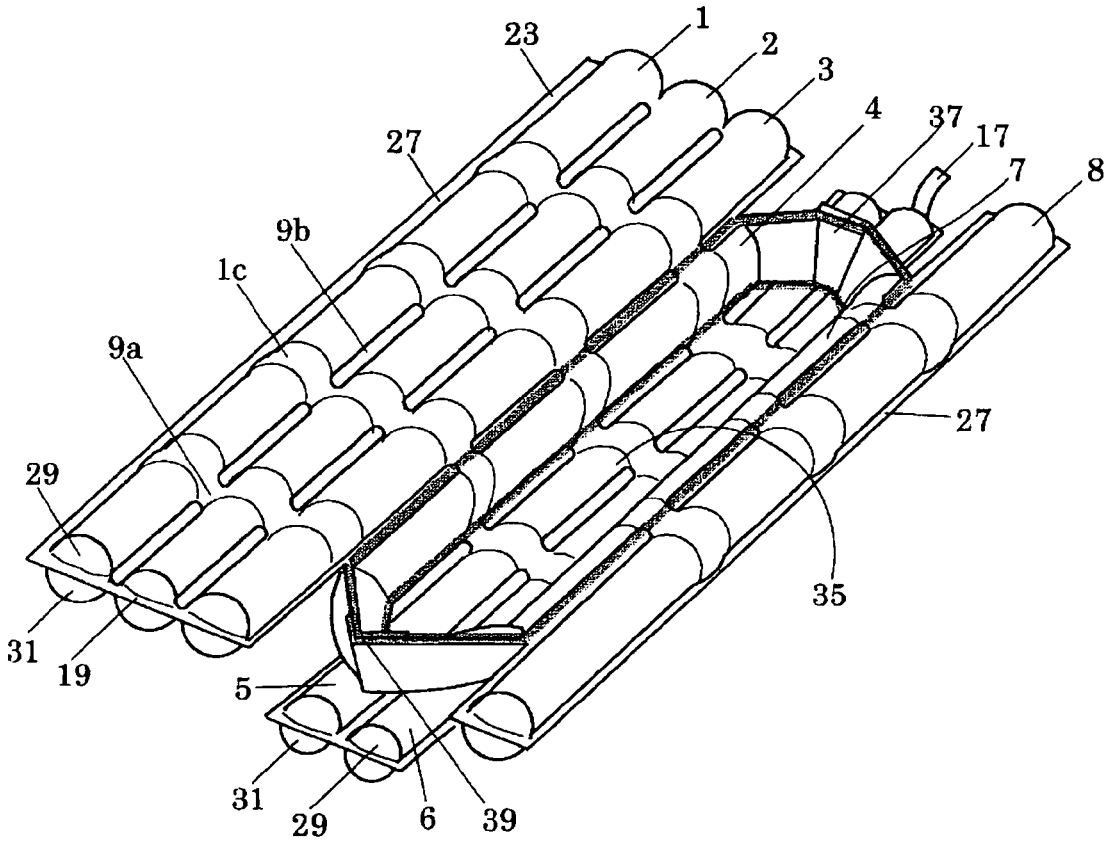
FIG. 3 is a schematic perspective view showing an exemplary construction of packaging material of gas-bag type according to the present invention.
Figure 4:
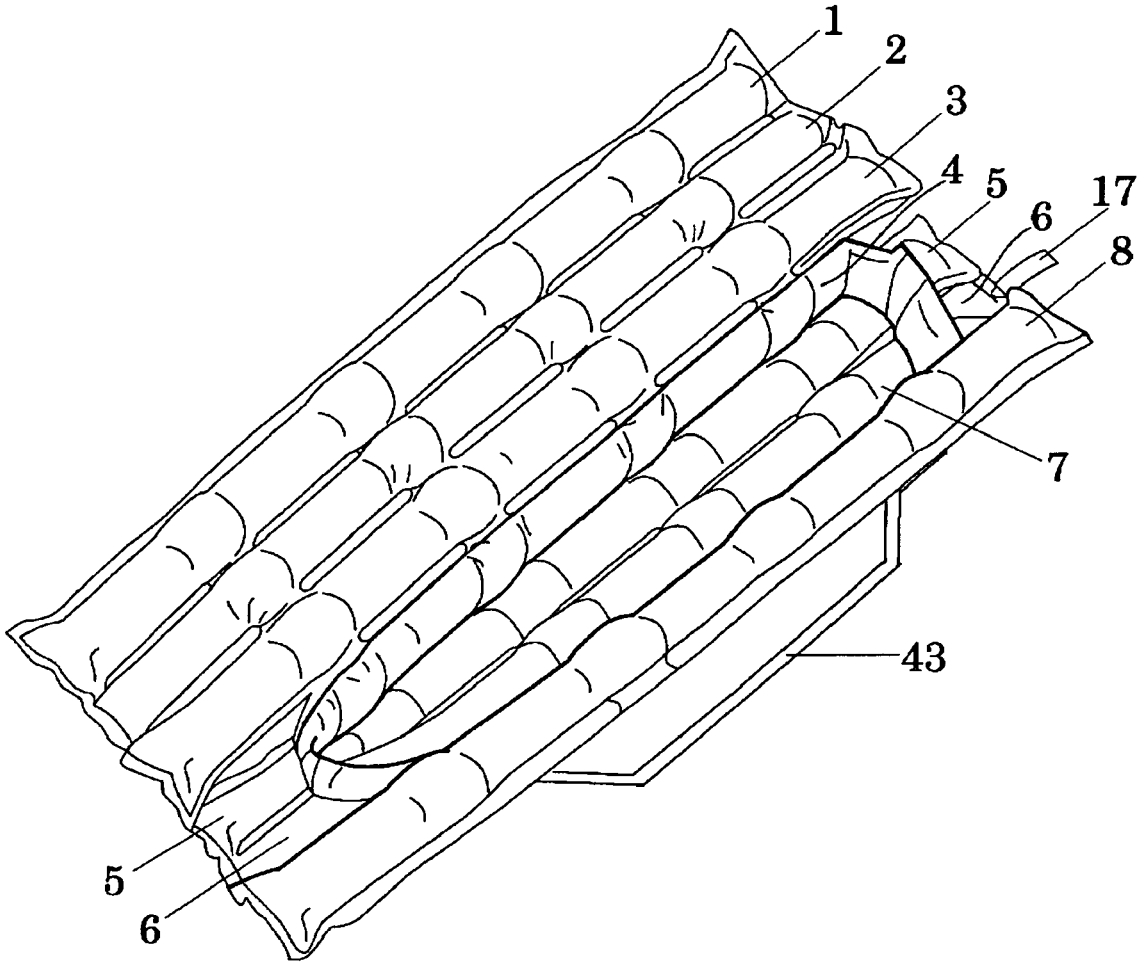
FIG. 4 is a schematic perspective view showing an exemplary construction of packaging material of gas-bag type having a gripping portion according to the present invention.

As shown in FIG. 3, the exemplary packaging material of gas-bag type is prepared from front and back sheets of two flexible materials. Front sheet material 29 is a sheet having a concave-convex surface, which performs to fix the packaged parts or devices of office equipment or OA equipment on the surface. Back sheet material 31 is a transparent sheet, which allows the direct observation as to the packaged conditions or abnormality as to easily deformable or breakable portions of the parts or devices, and immediate determination as to the way to remove the parts or devices.

Preferably, the front sheet material 29 having a concave-convex surface is of laminated construction of resin film sheet and divided-assigned sheet, and the resin film sheet is formed from three layers of polyethylene, polyamide, and polyethylene. Preferably, the sheet of transparent resin as well as the sheet having a concave-convex surface have an oxygen-gas permeability of 3 cc/m$^2$/24 hours or less; thereby the exemplary packaging material of gas-bag type can maintain the performance for a long period while preventing leakage of injected gas.

Figure 2A:
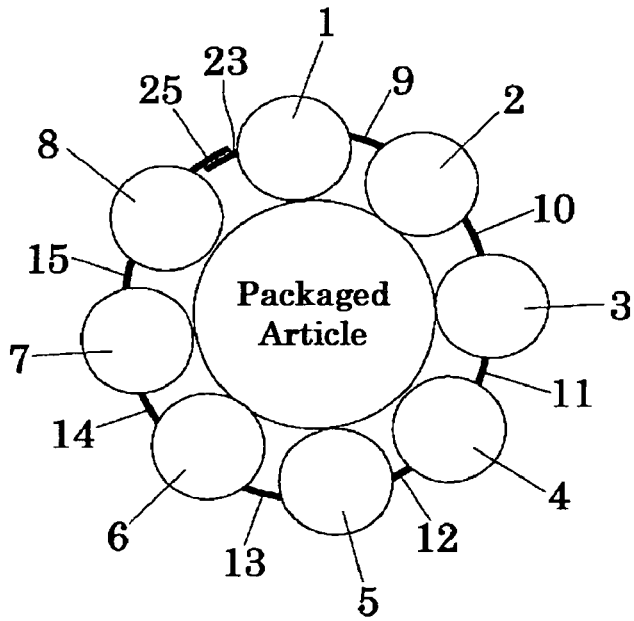
FIG. 2A is a schematic cross section showing an exemplary construction of packaging material of gas-bag type according to the present invention.

In the packaging material of gas-bag type, partial areas swell when gas is injected, wherein multiple flexible tube-like bodies 1 to 8 are formed in parallel and connected by connecting portions 9 to 15. Parts or devices of office equipment or OA equipment to be packaged are disposed on the packaging material, and the connecting portions 9 to 15 are bended toward the parts or devices to form a circle of the packaging material as shown in FIG. 2A thereby wrapping the parts or devices; then sealing portions 23 and 25 at both ends of right and left sides are connected to each other; thereby the parts or devices may be packaged.

Fastener 27 is provided at sealing portions 23 and 25 for connecting, separating, and re-connecting the sealing portions 23 and 25; the fastener may be selected from hook, pressure-sensitive adhesive, chuck, Magic Tape®, and the like. Tube-like bodies 1 to 8 possess multiple nodes 1*c* to 8*c* that exhibit a relatively large inflation compared to the other portions. Nodes 1*c* to 8*c* firmly fix the packaged parts or devices. Preferably, two or more tube-like bodies 1 to 8 are longer than the packaged parts or devices; thereby damage of packaged parts or devices may be prevented as a result of an accidental drop, for example.

In the exemplary packaging material of gas-bag type, tube-like bodies 1 to 8 are flexible so as to be bendable in the axial direction. In addition, cut portions 33 are provided at connecting portion 11 between tube-like bodies 3 and 4, at connecting portion 14 between tube-like bodies 6 and 7, and at connecting portion 15 between tube-like bodies 7 and 8. Therefore, tube-like body 4 for example can be bent to any directions of front side and back side apart from the adjacent tube-like bodies 3 and 5, and tube-like body 7 for example can be bent to any directions of front side and back side apart from the adjacent tube-like bodies 6 and 8. Connecting portions 11, 12, 14, and 15 are flexible and can be bent to any directions of front side and back side as described above. As a result, the exemplary packaging material of gas-bag type can form a boat-like or a rectangular concave space 35 with tube-like bodies 5 and 6 as the bottom portion, as shown schematically in cross-sectional view of FIG. 2B and entire constructive view of FIG. 3. The parts or devices of office equipment or OA equipment can be housed in the concave space 35 and be packaged firmly in the packaging material.

Figure 2B:
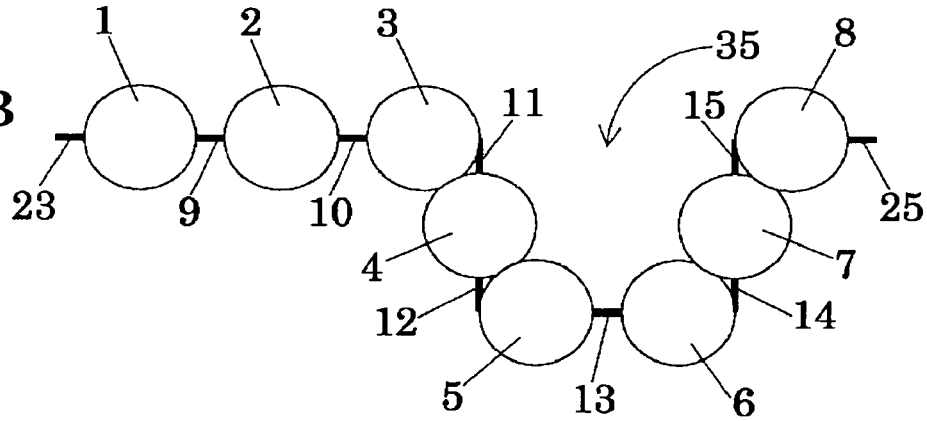
FIG. 2B is another schematic cross section showing an exemplary construction of packaging material of gas-bag type according to the present invention.

In order to form the boat-like or rectangular concave space 35 as shown in FIG. 2B and FIG. 3, the packaging material is bent at connecting portions 11, 12, 14, and 15 so as to form both side walls from tube-like bodies 4 and 7, and the axial ends of tube-like bodies 4 and 7 are engaged by means of attachable-detachable engaging portions 37 and 39 in a fastener mechanism. In this example, tube-like bodies 1, 2, 3, and 8, which are not employed directly to the form boat-like or rectangular concave space 35, cover the space 35 after parts or devices of office equipment or OA equipment are housed into the space 35. Accordingly, the attachable-detachable engaging portion 27 is provided at the both ends of tube-like bodies 1 to 8 in a fastener mechanism.

After the usageof the material, the exemplary packaging material of gas-bag type can be rendered to an approximately planar condition without concave space 35 by releasing the attachable-detachable engaging portions 37 and 39. The packaging material can be rendered to a thinner sheet-like body by evacuating gas from gas entrance 17. The selection as to the level of volume reduction can be optionally conducted.

In the explanation described above, concave space 35 is formed using tube-like bodies 4 and 7 as the side wall and tube-like bodies 5 and 6 as the bottom portion; the side wall and bottom portion may be formed other than the exemplary tube-like bodies.

Further, the exemplary packaging material of gas-bag type includes laminating regions 41 at around tip of cut portions 33 of tube-like bodies 4 and 7 in the direction perpendicular to the cut portions 33. Laminating regions 41 make the bending of tube-like bodies 4 and 7 easier to form both of the side walls.

In the exemplary packaging material of gas-bag type, cut portions 33 of tube-like bodies 4 and 7 may be replaced by tearable perforated lines. The tearable perforated lines may be provided around laminating regions 41 provided in the direction perpendicular to the cut portions 33. The example shown in FIG. 1 indicates the condition cut through a perforated line at the lower edges of tube-like bodies 4 and 7.

Preferably, gas entrance 17 is provided at an axial edge of one of tube-like bodies 1 to 8 at a location that does not disturb the packaging.

The packaging material of gas-bag type according to the present invention may package articles firmly, may afford less risk to damage packaged articles even when the packaged articles are dropped accidentally, and may represent less possibility for the packaged articles to slip off; therefore the articles packaged by the packaging material of gas-bag type according to the present invention may be transported and stored without additional packaging boxes.

In order to assure the advantage, preferably, a gripping portion 43 is provided to one of tube-like bodies 1 to 8. The gripping portion 43 may be fixed to the tube-like body or be formed in a detachable fashion.

Preferably, the friction between sheet material 31 having a concave-convex surface and parts or devices of office equipment or OA equipment is larger than the friction between sheet material 29 of transparent resin and the parts or devices; thereby the possibility that the packaged articles slip out of the packaging material of the present invention can be reduced still further. Preferably, the friction between sheet material 31 having a concave-convex surface and the parts or devices is 3 times to 10 times, more preferably 5 times to 7 times the friction between sheet material 29 of transparent resin and the parts or devices. Excessively high friction leads to difficulty in taking out the parts or devices, and on the other hand, excessively low friction leads to a lower ability for sustaining parts or devices.

In the packaging material of gas-bag type according to the present invention, preferably, the diameter of the tube-like bodies is 2 cm to 10 cm, more preferably is 4 cm to 6 cm. When the diameter of the tube-like bodies is less than 2 cm, the injection and discharge of gas tends to be difficult, and on the other hand, when the diameter of the tube-like bodies is more than 10 cm, the ability for sustaining parts or devices is likely to be insufficient.

The width of connecting portion 9 to 15 is preferably 0.5 cm to 3 cm, more preferably is 1 cm to 2 cm. When the width of connecting portion is less than 0.5 cm, the injection and discharge of gas tends to be difficult, and on the other hand, when the width of connecting portion is more than 3 cm, the ability for sustaining parts or devices is likely to be insufficient.

The pressure of the inner gas injected into tube-like bodies 1 to 8 is preferably 6 hPa to 9 hPa, more preferably is 7 hPa to 8 hPa. In order to inject gas with a pressure in the range, the pressured air from a compressor, booster and the like are preferably utilized. Excessively low pressure of the gas leads to insufficient protection from shock or impact, whereas excessively high pressure of gas may lead to slip out of parts or devices and also breakage of the tube-like bodies. The type of gas that may be injected into tube-like bodies 1 to 8 is not particularly limited, preferably the selected gas is air or nitrogen gas, more preferably nitrogen gas. The nitrogen gas injected into tube-like bodies 1 to 8 can extend the swelled period to 2 to 3 times that of air. This advantage may possibly compensate for the disadvantages that the cost of nitrogen gas is considerably higher than the cost of air and also the processing places to inject nitrogen gas are limited.

Figure 5:
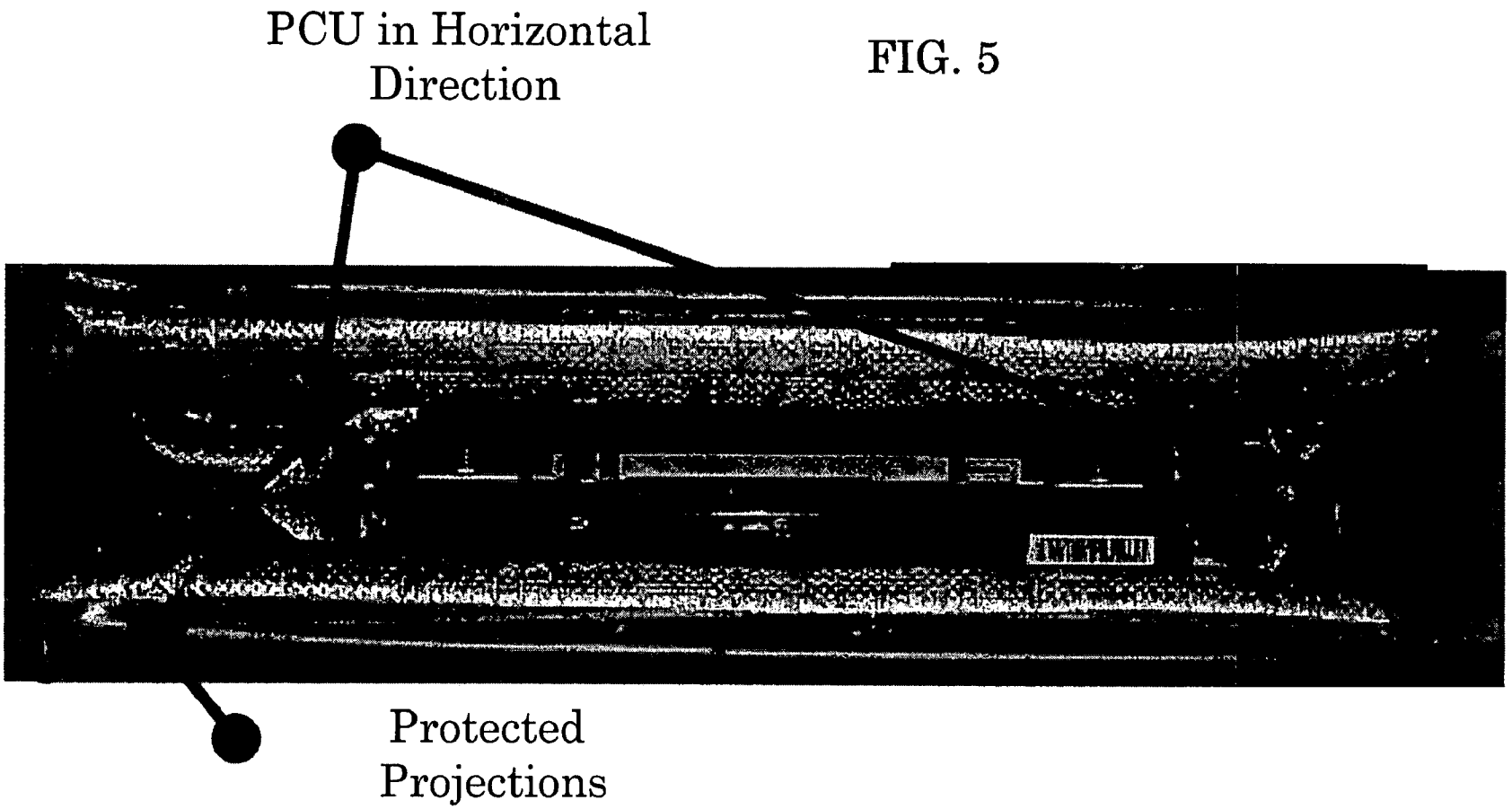
FIG. 5 is an exemplary photograph showing an application of packaging material of gas-bag type according to the present invention.
Figure 6:
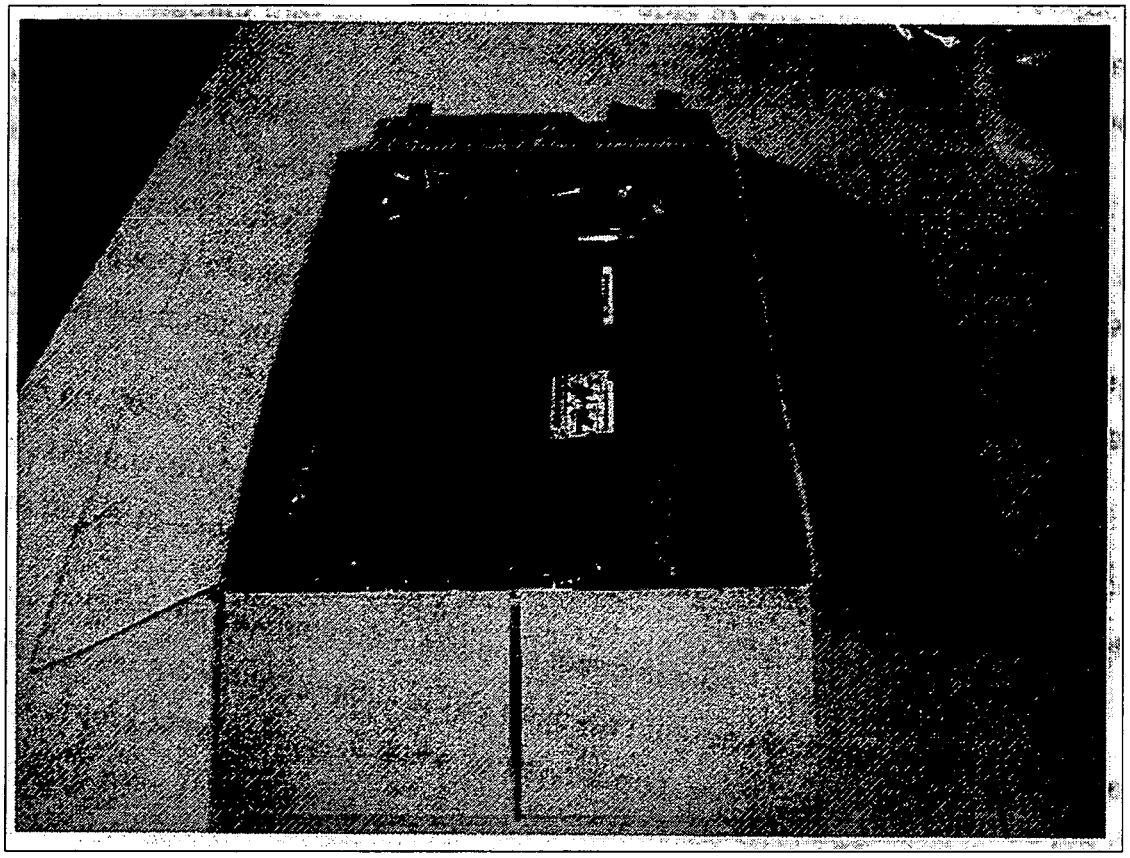
FIG. 6 is an exemplary photograph showing a conventional packaging material.
Figure 7:
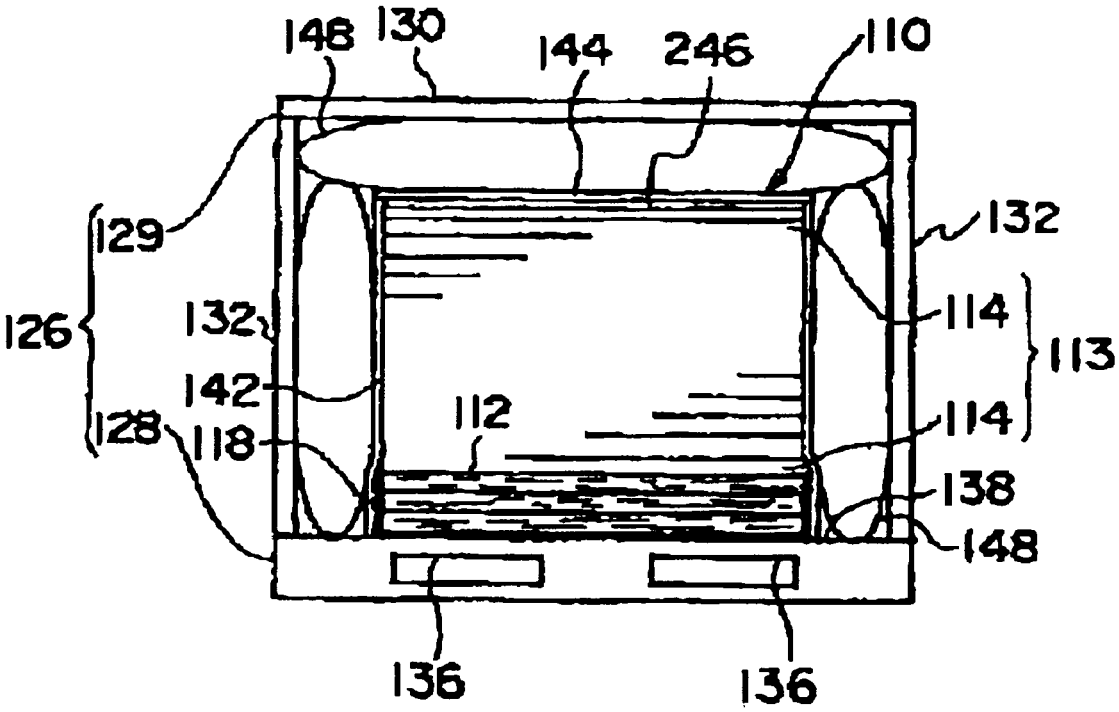
FIG. 7 is another exemplary photograph showing a conventional packaging material.
Figure 8:
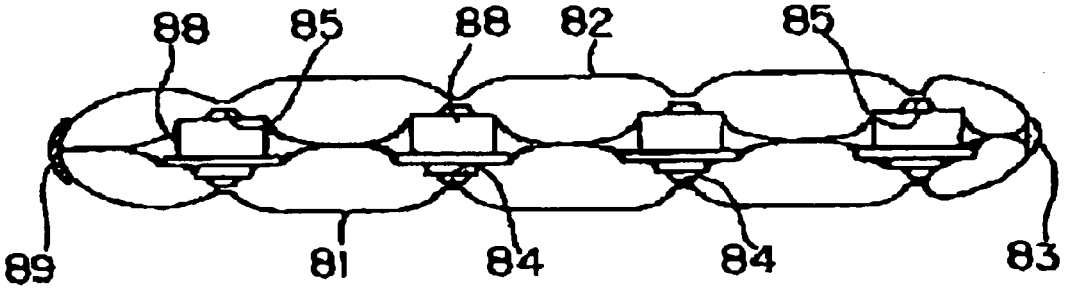
FIG. 8 is still another exemplary photograph showing a conventional packaging material.
Figure 9:
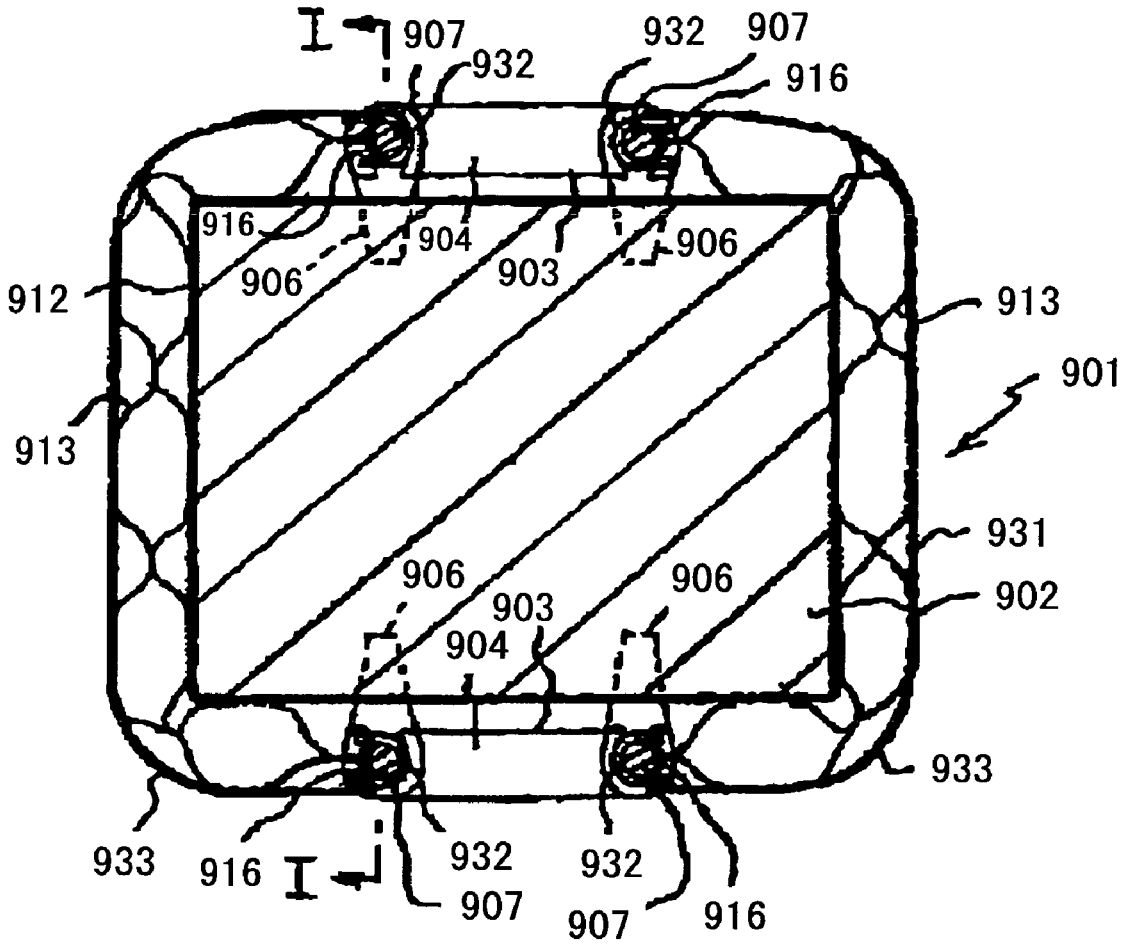
FIG. 9 is still another exemplary photograph showing a conventional packaging material.

FIG. 5 shows a condition that a PCU (processor control unit) is sustained in horizontal direction. Projections of PCU may be protected by somewhat elongating the horizontal length of the packaging material.

(Process for Producing Packaging Material of Gas-Bag Type)

In the process for producing a packaging material, the packaging material of gas-bag type according to the present invention may be produced.

The process includes laminating partially the front sheet and the back sheet to form adhered areas which correspond to the connecting portions and sealing portions at margin of the packaging material, and non-adhered areas which correspond to the tube-like bodies and gas passages communicating the tube-like bodies, and swelling the non-adhered areas to form tube-like bodies and gas passages communicating the tube-like bodies by injecting inner gas from a gas entrance.

In the partial laminating, two sheets of a front sheet and a back sheet are partially laminated to form adhered regions and non-adhered regions. The adhesion may be performed by thermal fusion of the two sheets or by adhesive bonding. The adhered regions yield the portions of connecting portions, and sealing portions at margin of the packaging material such as at the edges of the packaging material along the tube-like bodies, and the axial edges of the tube-like bodies, and also additional adhered areas at the end portion of the tube-like bodies if necessary.

In the inflating, non-adhered areas are inflated by injecting gas to form tube-like bodies and gas passages communicating with the tube-like bodies. Preferably, the pressure of the gas injected into the tube-like bodies is 6 hPa to 9 hPa, and the gas is air or nitrogen gas, more preferably, the gas is nitrogen gas.

The packaging material of gas-bag type according to the present invention may afford various effects, namely, the assembly of the packaging material and the packaging process are relatively simple and the operating periods are relatively short; various parts or devices such as containers of developing agent, cartridges with complicated construction, and parts with delicate properties may be firmly fixed in the packaging material since the packaging material is properly flexible, resilient, and hardly slippery; the volume of packaged articles is relatively small; separation or dropping of articles from the packaging material may be effectively prevented; the packaged articles may display higher impact resistance; transportation is relatively easy; decomposition of the packaged articles is relatively easy; the packaging material may be repeatedly utilized in decomposition and packaging; volume reduction may be conducted in two steps; and the cost of the packaging material is lower even with adaptability of recycle and reuse.

Further, articles may be protected without packaging boxes or other packaging materials, and the parts of packaging materials may be reduced, resulting in lower cost for packaging; the production of the packaging material is relatively simple, thus it is adapted to automatic production; the resulting packaging material may require less space to transport and to store, since the sheets are stackable.

Further, the partially transparent construction allows the observation as to the packaged conditions or abnormality as to easily deformable or breakable portions of the parts or devices, and immediate determination as to the way to take out the parts or devices; the packaged condition reduces the volume by decomposing into a flat condition; then further reduces the volume by discharging the gas; therefore, the level of volume reduction may be selected by considering the frequency of usages, the operating period for package, the space needed for working and the like; the sheet-like packaging material in the degassing condition allows for folding of the packaging material, resulting in efficient transportation and storage; the resilience of the packaging material may prevent damage to themselves such as pinhole, scratch, and breakage.

What is claimed is:

1. A packaging material of gas-bag type, comprising:

a plurality of inflatable tube-like bodies connected in parallel by connecting portions including gas passages, wherein the connecting portions do not contact each other such that gas can be spread via the gas passages between adjacent ones of the plurality of inflatable tube-like bodies;

at least two of the connecting portions having cut portions whereby a portion of the tube-like bodies are deformable in a direction away from the remaining tube-like bodies so as to wrap an article to be packaged and the packaging material is formed from two substantially flat sheets comprised of one front sheet and one back sheet.

2. The packaging material of gas-bag type according to claim 1, wherein the packaging material is bendable in substantially perpendicular directions to a longitudinal axis of the tube-like bodies.

3. The packaging material of gas-bag type according to claim 1, wherein the packaging material comprises adhered areas, non-adhered areas, and a gas entrance;

the non-adhered areas provide non-adhesion between the front sheet and the back sheet to create the gas passages between the tube-like bodies;

the adhered areas comprise adhesion between the front sheet and the back sheet and sealing portions at a margin of the packaging material.

4. The packaging material of gas-bag type according to claim 3, wherein each of the gas passages is provided between each connecting portion.

5. The packaging material of gas-bag type according to claim 1, wherein each tube-like body comprises nodes at which the tube-like body is larger compared to the other portions of the tube-like body.

6. The packaging material of gas-bag type according to claim 1, wherein one of the front sheet and the back sheet is a transparent resin sheet, and the other sheet comprises a concave-convex surface.

7. The packaging material of gas-bag type according to claim 6, wherein the sheet comprising a concave-convex surface comprises a laminated construction of a resin film sheet and a divided-assigned sheet.

8. The packaging material of gas-bag type according to claim 7, wherein the resin sheet is formed from three layers of polyethylene film, polyamide film, and polyethylene film.

9. The packaging material of gas-bag type according to claim 6, wherein both of the transparent resin sheet and the sheet comprising a concave-convex surface have an oxygen-gas permeability of 3 $cc/m^2/24$ hours or less.

10. The packaging material of gas-bag type according to claim 1, wherein the cut portions comprise at least one tearable perforated line parallel to a longitudinal axis of said tube-like bodies, each axis of the tube-like bodies being bendable to at least one of front side and back side of the packaging material, and at least one end portion of the tube-like bodies comprises a connectable portion.

11. The packaging material of gas-bag type according to claim 1, wherein the cut portions comprises at least one cut line in parallel to a longitudinal axis of said tube-like bodies, each tube-like body being bendable to at least one of front side and back side of the packaging material, and at least one end portion of the tube-like bodies comprises a connectable portion.

12. The packaging material of gas-bag type according to claim 4, wherein the tube-like bodies further include attachable and detachable engaging portions whereby the tube-like bodies are configured to attach to and detach from each other repeatedly at the connectable portion.

13. The packaging material of gas-bag type according to claim 1, wherein at least some of the tube-like bodies include at least one additional adhered area at an end portion of the tube-like bodies.

14. The packaging material of gas-bag type according to claim 13, wherein the at least one additional adhered area at the end portion of the tube-like bodies comprises at least one tearable perforated line.

15. The packaging material of gas-bag type according to claim 1, wherein a gas entrance is provided at an end portion of one of the tube-like bodies.

16. The packaging material of gas-bag type according to claim 1, wherein an elongated gripping portion is provided to the packaging material substantially in parallel to a longitudinal axis of the tube-like bodies.

17. The packaging material of gas-bag type according to claim 6, wherein friction between the sheet comprising a concave-convex surface and the packaged article is larger than friction between the transparent resin sheet and the packaged article.

18. The packaging material of gas-bag type according to claim 1, wherein the tube-like bodies are inflated by gas having a pressure of 6 hPa to 9 hPa.

19. The packaging material of gas-bag type according to claim 1, wherein the tube-like bodies are inflated by nitrogen gas.

20. The packaging material of gas-bag type according to claim 1, wherein a width of the connecting portions that connect the tube-like bodies in parallel is 0.5 cm to 3 cm.

21. The packaging material of gas-bag type according to claim 1, wherein a diameter of the tube-like bodies is 2 cm to 10 cm.

22. The packaging material of gas-bag type according to claim 1, wherein a number of the tube-like bodies is 2 or more.

23. The packaging material of gas-bag type according to claim 1, wherein the article to be packaged is at least one of parts and devices utilized in office equipment and OA equipment.

24. The packaging material of gas-bag type according to claim 1, wherein the article to be packaged is selected from a group consisting of containers containing toner, containers containing developing agent, photoconductors, process cartridges, and complex units of a developer and a toner collector.

* * * * *